US006405833B1

(12) United States Patent
Baranda et al.

(10) Patent No.: US 6,405,833 B1
(45) Date of Patent: Jun. 18, 2002

(54) FLEXIBLE FLAT ROPE SHEAVE ASSEMBLY WITH SEPARATE SHOULDER AND FLANGE SURFACES HAVING VARYING FRICTION PROPERTIES

(75) Inventors: Pedro S. Baranda, Farmington; Richard J. Ericson, Southington; John T. Pitts, Avon, all of CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/479,321

(22) Filed: Jan. 6, 2000

(51) Int. Cl.[7] ..... B66B 15/04; B66B 11/08

(52) U.S. Cl. ..... 187/254; 187/256; 187/259; 187/251; 474/151; 254/393

(58) Field of Search ..... 187/251, 252, 187/254, 256, 259, 260, 261, 262, 266; 254/390, 393, 902; 474/151, 168, 170, 171, 180, 186, 199

(56) References Cited

U.S. PATENT DOCUMENTS 1,035,230 A * 8/1912 Pearson ..... 187/254
1,164,115 A * 12/1915 Pearson ..... 187/254
RE15,737 E * 12/1923 Neenan ..... 187/254 X
1,944,426 A * 1/1934 Greening ..... 474/178
3,279,762 A * 10/1966 Bruns ..... 187/254 X
3,853,205 A * 12/1974 Gindroz, Jr. ..... 187/260
4,591,025 A * 5/1986 Honda ..... 187/254 X
5,411,444 A * 5/1995 Nakamura et al. ..... 474/167 X

FOREIGN PATENT DOCUMENTS

EP 521835 A1 * 1/1993

* cited by examiner

*Primary Examiner*—Eileen D. Lillis
*Assistant Examiner*—Thuy V. Tran

(57) ABSTRACT

A segmented elevator sheave assembly has independently variable shoulder and crowning elements for use with flexible flat ropes in an elevator system. This enables selection of high-traction surface finish and crowning for the sheave groove that contacts a belt, and of low-traction, smooth sheave groove shoulders having a low friction coefficient that may inadvertently contact the belt side surfaces. This configuration is more forgiving to angular misalignment of the sheave and reduces the likelihood of premature degradation of a flat flexible rope due side-surface scuffing along sheave groove shoulders.

9 Claims, 1 Drawing Sheet

100
104
102
106

10
62
54
58
50
42
66
18
46
38
70
72
30
20
34
32
36
40
44
22
48
52
56
60
64
68

12
14
16
18
20
22
46
36
48
24
26
28
38
40
50
52
54
56
32

FLEXIBLE FLAT ROPE SHEAVE ASSEMBLY WITH SEPARATE SHOULDER AND FLANGE SURFACES HAVING VARYING FRICTION PROPERTIES

TECHNICAL FIELD

The present invention relates to elevator technology and, more particularly, to friction sheaves for flat ropes having variable shoulder and crowning elements for controlled rope-sheave engagement.

BACKGROUND OF THE INVENTION

Certain elevator traction drive systems utilize flexible, flat ropes for various advantages over traditional round-sectioned ropes. In addition to several performance and durability advantages, there are certain disadvantages associated with flexible flat ropes. Among them, is the potential for belt tracking problems.

Tracking problems can lead to a variety of performance problems. For example, improper belt tracking can lead to undesirable noise which may be discomforting to passengers in an elevator car who perceive the noise as an indication of an unsafe condition. Improper tracking may affect the smoothness of the elevator car ride. Extended improper tracking may result in premature wear and may require premature replacement of elevator belts.

OBJECTS AND SUMMARY OF THE INVENTION

It is an object of the present invention to provide a sheave design that minimizes or eliminates improper belt tracking in an elevator system.

It is a further object of the present invention to overcome the shortcomings attributable to conventional and known elevator sheave designs such as those described above.

These and other objects are achieved by the present invention in the manner described below.

Testing has shown that sheaves made from a single material, such as steel or cast iron, can be prone to tracking problems with flexible flat ropes. For instance, when the belt is off-center with regard to a belt groove the belt may rub on the shoulder of the belt groove. This condition leads to undesirable noise and eventual degradation of the belt. The rate of belt degradation along the side of the belt groove is dependent on the level of sheave misalignment as well as on the material interface between the belt and the sheave materials. Typical flexible flat ropes comprise a jacket made of a flexible material such as urethane. While the urethane jacket engages the bottom of the sheave belt groove with a desired amount of friction, it also has a tendency to engage the groove shoulder when misaligned, causing undesirable frictional engagement with the shoulder.

The amount of crowning on the bottom of the sheave groove is a factor affecting belt tracking. Excessive crowning, forming a convex surface in profile, promotes belt degradation due to unequal stress gradients in the flexible flat rope during operation. On the other hand, insufficient crowning can result in the belt being undesirably sensitive to sheave misalignments.

The traction capacity of a drive sheave is an important factor in the design and operation of an elevator system. As the desired traction dictates the material selection and surface finish of a sheave groove, the surrounding surfaces, such as the groove shoulders, are the same as the belt-contact surface of the groove in conventional sheave designs. This is due to the use of single material and uni-body construction for some components of conventional sheaves.

The present invention is directed to a segmented elevator sheave assembly having independently variable shoulder and crowning elements for use with flexible flat ropes in an elevator system. This enables selection of high-traction surface finish and crowning for the sheave groove that contacts the belt, and of low-traction, smooth sheave groove shoulders having a low friction coefficient that may inadvertently contact the belt side surfaces. A center hub mounted to two bearings for concentric rotation provides means for keeping the segments of the sheave in a concentric relationship. The present invention design makes the system more forgiving to angular misalignment of the sheave and reduces the likelihood of premature degradation of the flat flexible rope due side-surface scuffing along sheave groove shoulders.

DESCRIPTION OF THE PREFERRED EMBODIMENTS

Figures 1, 2, 3:
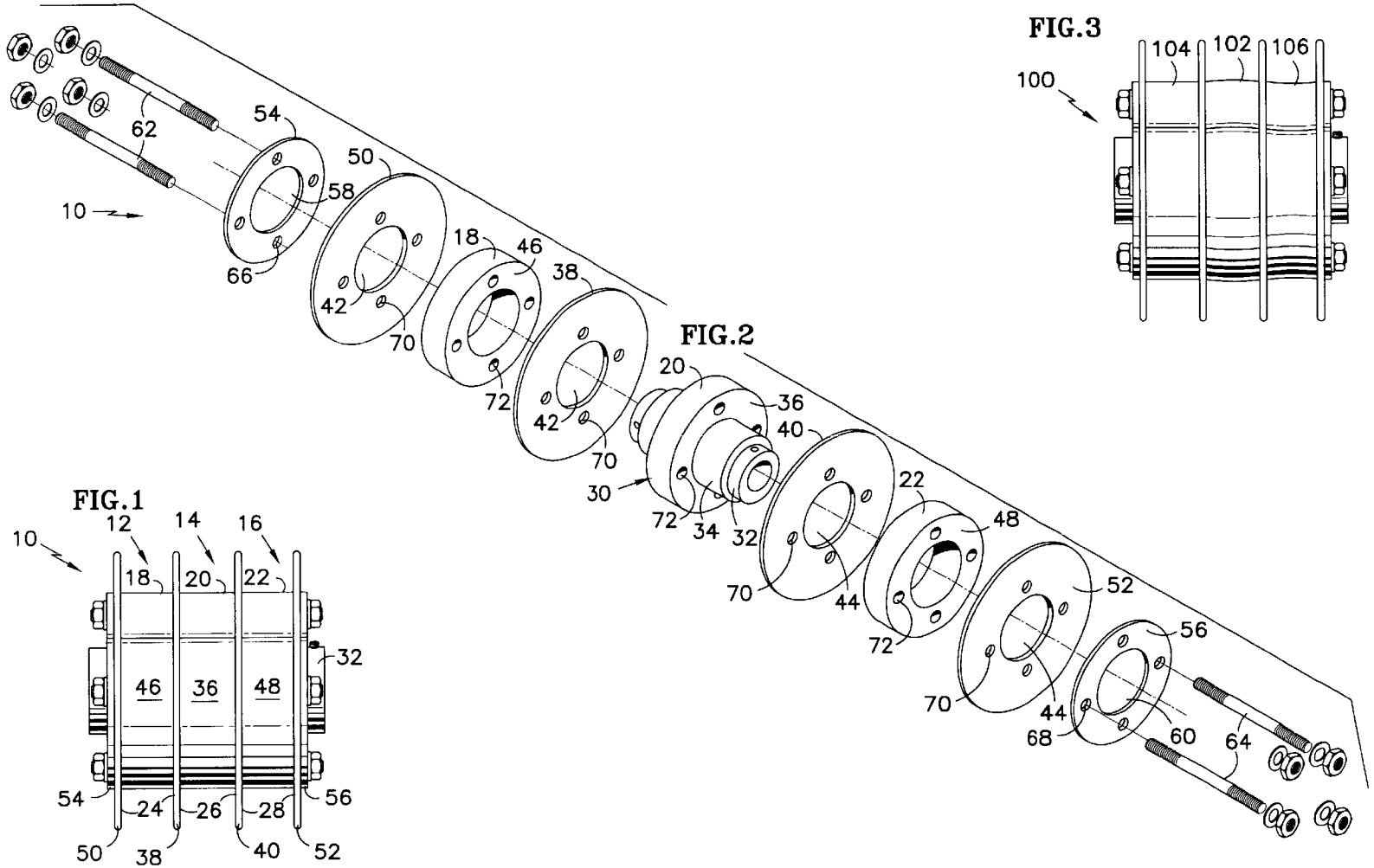
FIG. 1 is a schematic front view of a sheave assembly according to a first preferred embodiment of the present invention.
FIG. 2 is a schematic exploded view of the sheave assembly represented in FIG. 1.
FIG. 3 is a schematic front view of a sheave assembly according to a second preferred embodiment of the present invention.

An elevator sheave assembly (10) according to the present invention is illustrated in FIG. 1 and FIG. 2. The sheave (10) comprises multiple sheave grooves (12, 14, 16) having bottom surfaces (18, 20, 22) and shoulder surfaces (24, 26, 28). Although three sheave grooves are shown in the preferred embodiment, any desired number of sheave grooves may be provided. And while the sheave groove bottom surfaces shown in FIG. 1 and FIG. 2 are shown having generally flat profiles, they may be made concave or convex, as shown in FIG. 3 and discussed below.

Referring to the exploded view in FIG. 2, the sheave (10) includes a central hub (30) having an inner bearing sleeve (32), an outer bearing sleeve (34), and a central ring member (36). The outer circumference of the central ring member (36) forms the middle sheave groove bottom surface (20). The inner sleeve bearing (32) is received concentrically within the outer sleeve bearing (34) in a close-fitting relationship and adapted to rotate relative thereto. The inner sleeve bearing (32) is adapted to fit over an axle or axle bearing that makes up part of the overall sheave assembly (not shown). The central ring member (36) fits around the outer sleeve bearing (34) and is fixed against relative rotation therewith.

The outer sleeve bearing (34) has sufficient length to accommodate additional sleeve bearings and related structure as will now be discussed. First and second separator plates (38, 40) each having a generally flat, disc shape with a hole (42, 44) in the middle are positioned over the outer sleeve bearing (34) on either side of the central ring member (36). The first and second separator plates (38, 40) together with the middle sheave groove bottom (20) form the middle sheave groove (14). The facing radial surfaces of each of the first and second separator plates (38, 40) form the shoulder surfaces (26) of the middle sheave groove (14).

On each side of the first and second separator plates (38, 40), second and third ring-members (46,48) are, respectively, positioned over the outer sleeve bearing (34). Third and fourth separator plates (50, 52) are, respectively, positioned over the outer sleeve bearing adjacent to one of the second and third ring-members (46, 48). The first and third separator plates (38, 50) together with the first side sheave groove bottom (18) form the first side sheave groove (12). The facing radial surfaces of each of the first and third separator plates (38, 50) form the shoulder surfaces (24) of the first side sheave groove (12). The second and fourth separator plates (40, 52) together with the second side sheave groove bottom (22) form the second side sheave groove (16). The facing radial surfaces of each of the second and fourth separator plates (40, 52) form the shoulder surfaces (28) of the second side sheave groove (16).

First and second end retaining plates (54, 56) are provided, respectively, at each end of the assembly as shown in FIGS. 1 and 2. The retaining plates (54, 56) each have central openings (58, 60) that are sized to fit over the inner sleeve bearing (32). A set of bolts (62, 64) are provided to pass through retaining plate holes (66, 68), separator plate holes (70), and ring-member holes (72) to hold the assembly together.

The materials and specific geometries for the ring-members and the separator plates may be individually selected and combined with similar or non-like counterparts to make up one sheave assembly according to the present invention. For example, the ring-members may be made of materials selected so that the groove bottoms exhibit optimum traction with the elevator belts, while the separator plates may be made of materials, such as DELRIN™ or UHMWP, that exhibit low-friction characteristics. Different groove bottom surface profiles may be implemented, as discussed with reference to FIG. 3.

The ring-members may be provided with varying profiled geometry on the outer circumferential surface to form desired crowning on the belt contact surface. While the groove bottoms shown in FIG. 1 appear flat, one or more convex profiled groove bottoms may be implemented as shown in FIG. 3. Referring to FIG. 3, a sheave assembly (100) according to the present invention and of similar design to that described with respect to FIGS. 1–2 may have at least one convex profiled groove bottom surface (102). The other groove bottom surfaces (104, 106) may be flat or convex, according to preference.

The interchangeability of the sheave assembly components allows replacement of worn or damaged individual ring members or separator plates, or selective assembly of distinct components for a particular application.

While the preferred embodiments have been described, it is understood that variation and modification may be without departing from the scope of the presently claimed invention.

What is claimed is:

1. An elevator sheave assembly comprising:

a plurality of discrete ring members each having an outer circumferential surface adapted to engage an elevator rope in frictional contact, said ring members being generally coaxially aligned with respect to each other; and a plurality of discrete separator plates interposed between adjacent ones of said ring members such that said separator plates form contact shoulders for contacting side surfaces of the elevator rope, said separator plates having a rope-engaging surface having a different coefficient of friction than the outer circumferential surfaces of said ring members.

2. An elevator sheave assembly according to claim 1, further comprising a first bearing member received through and generally concentrically aligned with said ring members and said separator plates.

3. An elevator sheave assembly according to claim 1, wherein said plurality of separator plates are generally coaxially aligned with said ring members.

4. An elevator sheave assembly according to claim 1, wherein the outer circumferential surface of at least one of said ring members has a radially-outward extending convex shape in profile.

5. An elevator system having a sheave assembly, said sheave assembly comprising:

a plurality of discrete elevator rope engaging ring members generally coaxially aligned with respect to each other, each said ring member having an outer circumferential surface having a first friction coefficient and being adapted to engage an elevator rope in frictional contact;

a first bearing member received through and generally concentrically aligned with said rope engaging ring members; and a plurality of discrete separator plates interposed between adjacent ones of said ring members such that said separator plates form contact shoulders having a second friction coefficient, different from said first friction coefficient, for contacting side surfaces of said elevator rope.

6. An elevator system according to claim 5, wherein the outer circumferential surface of at least one of said ring members has a radially-outward extending convex shape in profile.

7. An elevator system comprising a plurality of elevator rope-engaging bodies each having a plurality of independently interchangeable crowning elements that are generally coaxial, and independently interchangeable shoulder elements interposed between the crowning elements.

8. An elevator system according to claim 7, wherein the crowning elements of said elevator rope-engaging bodies each comprise a ring-shaped member having an outer circumferential surface adapted to engage an elevator rope.

9. An elevator system according to claim 8, wherein the outer circumferential surface of at least one of said elevator rope-engaging bodies has a radially outward-extending convex shape in profile.

* * * * *